US008258913B2

(12) United States Patent
Matsumura

(10) Patent No.: US 8,258,913 B2
(45) Date of Patent: Sep. 4, 2012

(54) FUSE ELEMENT AND METHOD OF MANUFACTURING THE SAME

(75) Inventor: Norio Matsumura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 281 days.

(21) Appl. No.: 11/845,996

(22) Filed: Aug. 28, 2007

(65) Prior Publication Data

US 2008/0048820 A1 Feb. 28, 2008

(30) Foreign Application Priority Data

Aug. 28, 2006 (JP) ..... 2006-230949

(51) Int. Cl.
*H01H 85/10* (2006.01)
*H01H 85/00* (2006.01)
*H01H 69/02* (2006.01)

(52) U.S. Cl. ..... 337/295; 337/290; 337/159; 337/142; 29/623

(58) Field of Classification Search ..... 337/299, 337/295, 290, 142, 159; 29/623
See application file for complete search history.

(56) References Cited

U.S. PATENT DOCUMENTS 1,874,949 A * 8/1932 Fogal ..... 337/241
1,925,060 A 8/1933 Stephenson
2,662,952 A * 12/1953 Nivoix ..... 337/222
2,682,587 A * 6/1954 Burt et al. ..... 337/232
2,773,961 A * 12/1956 Sundt ..... 337/166
2,796,494 A * 6/1957 Barnes ..... 337/416
2,828,390 A * 3/1958 Mcalister ..... 337/232
3,417,357 A * 12/1968 Withers ..... 337/295
3,432,923 A * 3/1969 Feenan et al. ..... 29/623
3,714,613 A * 1/1973 Appleton ..... 337/295
4,023,265 A * 5/1977 Aryamane ..... 29/623
4,219,793 A 8/1980 Kawamura
4,344,060 A * 8/1982 Ciesemier et al. ..... 337/260
4,349,804 A 9/1982 Gaia
4,488,137 A * 12/1984 Rooney et al. ..... 337/162
5,097,246 A * 3/1992 Cook et al. ..... 337/297
5,120,152 A * 6/1992 Gueli ..... 403/179
5,229,739 A * 7/1993 Oh et al. ..... 337/290
5,293,147 A * 3/1994 Oh et al. ..... 337/227
5,373,278 A * 12/1994 Saulgeot et al. ..... 337/255
5,581,225 A 12/1996 Oh et al.

(Continued)

FOREIGN PATENT DOCUMENTS

DE 2800932 A1 8/1978

(Continued)

OTHER PUBLICATIONS

German Office Action dated Nov. 20, 2008.

(Continued)

*Primary Examiner* — Bradley Thomas
(74) *Attorney, Agent, or Firm* — Sughrue Mion, PLLC

(57) ABSTRACT

A fuse element includes a first conductive part and a second conductive part, and a fusible body which electrically connect the first conductive part and the second conductive part, and fuses when an overcurrent flows itself. The fusible body is formed in a plate shape. The fusible body has a first connection portion, a second connection portion and a fusing member, both ends of the fusing member being connected to the first connection portion and the second connection portion respectively. The fusing member is displaced from the first connection portion and the second connection portion in a first direction being intersect with a second direction in which the first and second connection portions are arranged.

19 Claims, 2 Drawing Sheets

U.S. PATENT DOCUMENTS

| | | | | | |
|---|---|---|---|---|---|
| 5,644,282 | A * | 7/1997 | Mehta et al. | 337/295 |
| 5,668,522 | A * | 9/1997 | Kondo et al. | 337/198 |
| 5,686,878 | A * | 11/1997 | Gueli | 337/416 |
| 5,790,007 | A * | 8/1998 | Yasukuni | 337/166 |
| 5,793,275 | A * | 8/1998 | Iversen | 337/273 |
| 5,821,847 | A * | 10/1998 | Totsuka | 337/166 |
| 5,854,583 | A * | 12/1998 | Falchetti | 337/290 |
| 5,929,740 | A * | 7/1999 | Oh et al. | 337/198 |
| 6,067,004 | A * | 5/2000 | Hibayashi et al. | 337/227 |
| 6,075,434 | A * | 6/2000 | Rueckling | 337/160 |
| 6,160,471 | A * | 12/2000 | Rybka et al. | 337/278 |
| 6,163,244 | A * | 12/2000 | Endo et al. | 337/160 |
| 6,275,135 | B1 * | 8/2001 | Hibayashi et al. | 337/227 |
| 6,404,322 | B1 * | 6/2002 | Ruegsegger et al. | 337/416 |
| 6,448,882 | B1 * | 9/2002 | Inaba et al. | 337/227 |
| 6,486,766 | B1 * | 11/2002 | Reid et al. | 337/186 |
| 6,552,645 | B2 * | 4/2003 | Kuczynski | 337/111 |
| 6,570,482 | B2 * | 5/2003 | Brown et al. | 337/160 |
| 6,830,482 | B2 * | 12/2004 | Matsumura et al. | 439/620.27 |
| 8,154,377 | B2 * | 4/2012 | Lietz et al. | 337/290 |
| 2003/0156005 | A1 * | 8/2003 | Ohashi et al. | 337/160 |
| 2004/0169578 | A1 * | 9/2004 | Jollenbeck et al. | 337/227 |
| 2004/0196135 | A1 * | 10/2004 | Clair | 337/198 |

FOREIGN PATENT DOCUMENTS

| | | | |
|---|---|---|---|
| GB | 1 300 136 | | 12/1972 |
| JP | 57-78746 | A | 5/1982 |
| JP | 9-265891 | A | 10/1997 |
| JP | 11-120890 | A | 4/1999 |
| JP | 2001-325874 | A | 11/2001 |
| JP | 2004-6425 | A | 1/2004 |

OTHER PUBLICATIONS

Notification of Reasons for Refusal dated May 10, 2011, in Japanese Application No. 2006-230949.

* cited by examiner

FUSE ELEMENT AND METHOD OF MANUFACTURING THE SAME

BACKGROUND OF THE INVENTION

This invention relates to a fuse element having a fusible body which electrically connect one conductive part such as a terminal or a bus bar and the other conductive part such as a terminal or a bus bar, and fuses when an overcurrent flows, and a method for manufacturing the same.

The fusible body of an fuse element is formed so that it fuses owing to the heat generated by itself when an overcurrent exceeding the rating flows. In order that the quantity of generated heat enough to be fused is assured, the fusible body is required to have a higher resistance than the terminal. So, there are traditionally known fuse elements in which the thickness of the fusible body is made thinner than that of a terminal or a conductive member such as the bus bar by press working (for example, see Patent Reference 1), in which the fusible body is partially notched to reduce the sectional area (for example, see Patent Reference 2), and in which the material to be stamped into the shape of the fuse element is previously worked thin at the portion to be the fusible body (for example, see Patent Reference 3).

Patent Reference 1: JP-A-2001-325874
Patent Reference 2: JP-A-9-265891
Patent Reference 3: JP-A-11-120890

However, where the resistance of the fusible body is changed to set the rating of the fuse element at various values, in the fuse element disclosed in Patent Reference 1, in adjusting the thickness of the fusible body, distortions in the pitch between the terminals may produced. In the fuse element disclosed in Patent Reference 2, a plurality of dies for notching the fusible body are required and so the manufacturing cost may Increase. In addition, replacement of the die is required each time so that the productivity may decrease, Further, in the fuse element disclosed in Patent Reference 3, the material must be previously worked according to the resistance of the fusible body and so the manufacturing cost may increase.

SUMMARY OF HE INVENTION

This Invention has been accomplished in view of the circumstances described above. An object of this invention is to provide a fuse element in which its rating can be set at various values and the manufacturing cost can be reduced and a method for manufacturing such a fuse element.

The above object can be attain by the fuse element listed in the following items (1) to (4) and the method of manufacturing the fuse element listed in the following items (5) to (8).

(1) A fuse element comprising:

a first conductive par and a second conductive part; and a fusible body which electrically connect the first conductive part and the second conductive part, and fuses when an overcurrent flows itself, wherein the fusible body is formed in a plate shape;

wherein the fusible body has a first connection portion, a second connection portion and a fusing member, both ends of the fusing member being connected to the first connection portion and the second connection portion respectively; and wherein the fusing member is displaced from the first connection portion and the second connection portion in a first direction being intersect with a second direction in which the first and second connection portions are arranged.

(2) The fuse element according to above item 1 wherein a first displacement amount between the fusing member and the first connection portion is different from the second displacement amount between the fusing member and the second connection portion.

(3) The fuse element according to above item 1 wherein the fusible body is made of a copper alloy.

(4) The fuse element according to above item 1 wherein the fusible body is displaced from the first connection portion and the second connection portion to set a desired resistance of the fusible body.

(5) A method of manufacturing a fuse element having a fusible body electrically connecting the first conductive part and the second conductive part the fusible body fusing when an overcurrent flows itself, comprising:

forming the fusible body in a plate shape, the fusible body having a first connection portion, a second connection portion and a fusing member, both ends of the fusing member being connected to the first connection portion and the second connection portion respectively, displacing the fusing member from the first connection portion and the second connection portion in a first direction being intersect with a second direction in which the first and second connection portions are arranged.

(6) The method of manufacturing a fuse element according to above item 5, wherein a first displacement amount between the fusing member and the first connection portion is different from the second displacement amount between the fusing member and the second connection portion.

(7) The method of manufacturing a fuse element according to above item 5, wherein the fusible body is made of a copper alloy.

(8) The method of manufacturing a fuse element according to above Item 5, wherein the fusible body is displaced from the first connection portion and the second connection portion to set a desired resistance of the fusible body.

In accordance with the fuse element having the above item (1) and the method of manufacturing a fuse element having the above item (5), by displacement working of the fusing member, the sectional area of both ends of the fusing member connected to the remaining portions (connection portions) of the fusible body is reduced, and increased or decreased according to the displacement amount of the fusing member. Therefore, by adjusting the displacement amount of the fusing member, the resistance of both ends of the fusing member can be optionally set within a predetermined range. Thus, the rating of the fuse element can be set at various values.

The displacement amount of the fusing member can be adjusted using a single die. Therefore, labor such as replacement of the die or change of the material is not required. Thus, the fuse element having various ratings can be manufactured with good yield and the productivity can improved, Accordingly, the manufacturing cost can be reduced.

Further, in the vicinity of both ends of the fusing member, the thickness of the fusible body before displacement working is maintained so that the heat generated at both ends of the fusing member is absorbed to a certain degree. For this reason, as compared with the case where the thickness of the entire fusible body is thinned, greater resistance to a rushing current for the fuse element can be obtained.

In accordance with the fuse element having the above item (2), (4) and the method of manufacturing a fuse element having the above item (6), (8), of both ends of the fusing element, at the end with a greater displacement amount, its sectional area is reduced more greatly and its resistance is increased more greatly. Thus, this end will be fused. In this way, if the fused area can be specified, this is convenient to confirm fusing.

In accordance with the fuse element having the above item (3) and the method of manufacturing a fuse element having the above item (7), it is convenient to form the fusing element by displacement working.

In accordance with this invention, there is provided a fuse element in which is rating can be set at various values and the manufacturing cost can be reduced and a method for manufacturing such a fuse element.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
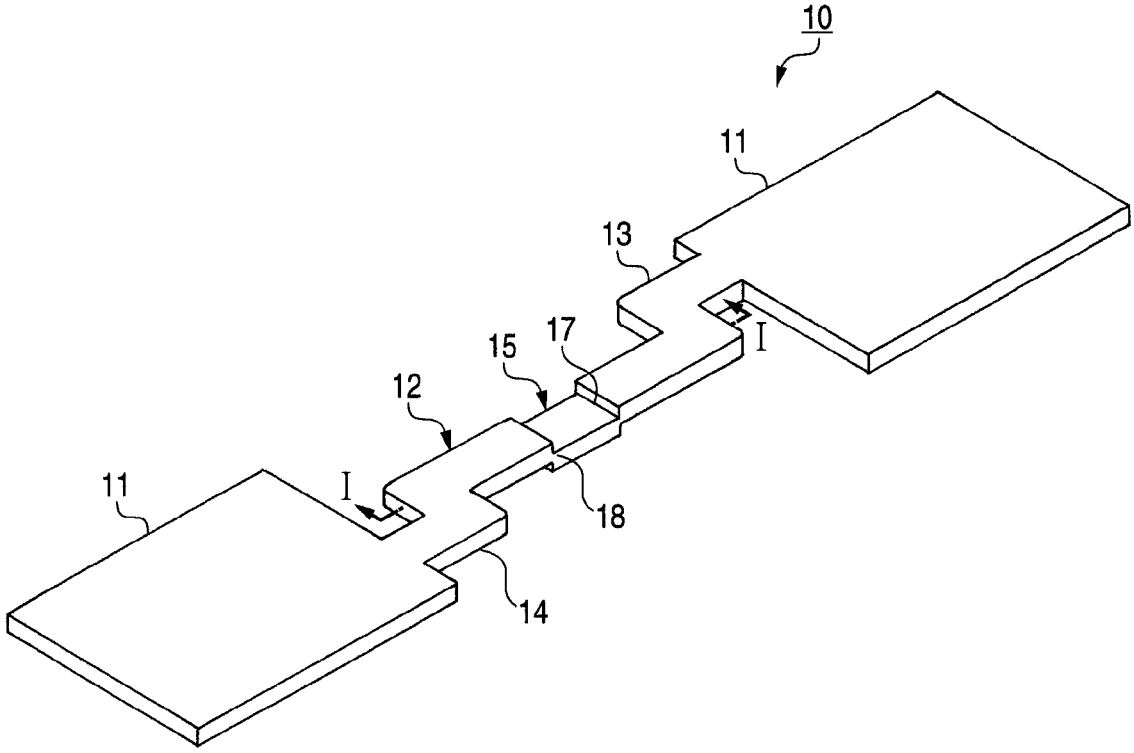
FIG. 1 is an external appearance perspective view of a fuse element manufactured by the method of manufacturing a fuse element according to this invention.

Now referring to the drawings, an explanation will be given of preferred embodiments of this invention.

Figure 2:
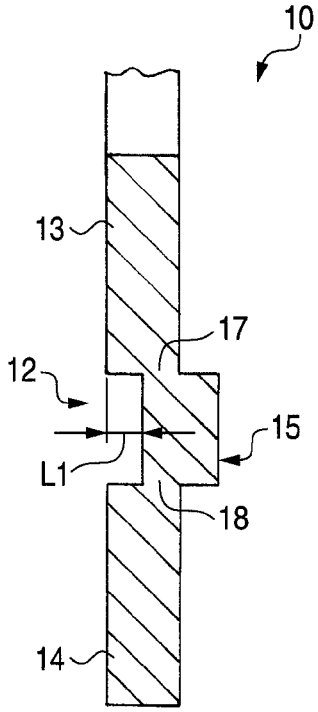
FIG. 2 is a sectional view taken in line I-I in the fuse element shown in FIG. 1.
Figure 3:
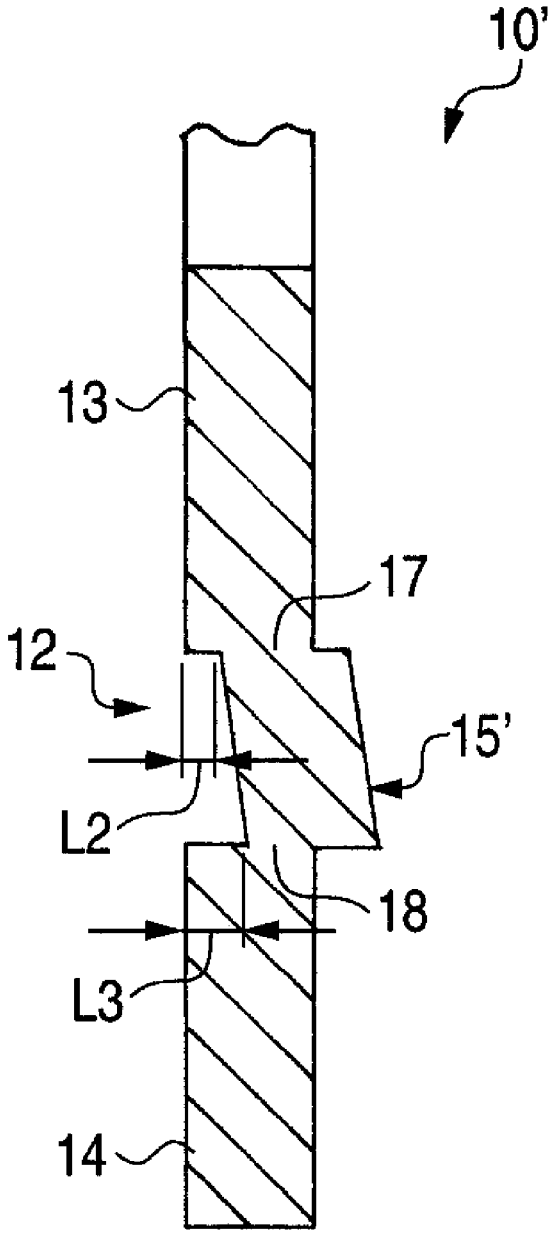
FIG. 3 is a sectional view of a modification of the fuse element shown in FIG. 1.

FIG. 1 is an external appearance perspective view of a fuse element manufactured by the method of manufacturing a fuse element according to this invention, FIG. 2 is a sectional view taken in line I-I in the fuse element shown in FIG. 1. FIG. 3 is a sectional view of a modification of the fuse element shown in FIG. 1.

As seen from FIGS. 1 and 2, a fuse element 10 is provided with a pair of terminals 11 each connected to an electric circuit (not shown), and a fusible body 12 which electrically connects the pair of terminals 11 to each other. Further, at least one of the terminals may be the conductive member such as a bus bar.

The terminal 11 is formed in the shape of a nearly square plate, The fusible body 12 is formed in a belt-like shape. It both ends in a longitudinal direction are connected to the edges of the terminals 11, respectively. The exterior of such a fuse element 10 is formed by stamping a single metallic sheet in a predetermined shape.

The fusible body 12 is formed to have a thinner width than that of the terminal 11 so that resistance per unit length of the former is higher than that of the latter. The fusible body 12 is particularly provided with a fusing member 15 which will fuse by heat generated when an overcurrent exceeding the rating flows.

The fusing member 15 is located at the central area in the longitudinal direction of the band plate-like fusible body 12. A part of the fusible body 12 is displaced in the direction of the plate thickness over the entire width. The fusing member 15 is adapted to traverse the fusible body 12 in a direction crossing a current-passing direction.

Now, the metallic sheet to be the fuse element 10 is preferably made of a material having great malleability/ductility such as a copper alloy, and is preferably used to form the fusing member 15 by displacement working.

Connecting portions 13, 14 are provided on both sides of the fusing member 15. The connecting portions 13, 14 are remainders of the fusing member 12 and connect the fusing member 15 to the one edges of the terminals 11, respectively. Both ends 17, 18 of the fusing member 15 which are connected to these connecting portions 13, 14 are squeezed by the displacement working of the fusing member 15 so that their sectional area is reduced and the resistance is particularly increased.

The sectional areas of both ends 17, 18 of the fusing member 15 increases or decreases according to the displacement amount L1 of the fusing member 15. Therefore, by adjusting the displacement amount of the fusing member 15, the resistance of both ends 17, 18 of the fusing member 15 can be optionally set within a predetermined range.

When the overcurrent exceeding the rating continuously flows, both ends 17, 18 of the fusing member 15, in which the resistance is particularly increased, generate a large quantity of heat. In addition, both ends 17, 18 are squeezed to be thin by displacement working. For this reason, owing to the heat generated by themselves, both ends 17, 18 are fused more swiftly than the remaining portion and interrupt the circuit.

As described above, in accordance with the fuse element 10 according to this embodiment and its manufacturing method, by displacement working of the fusing member 15, the sectional area of both ends 17, 18 of the fusing member 15 connected to the connecting portions 13, 14 of the fusible body 12 is reduced, and increased or decreased according to the displacement amount L1 of the fusing member 15. Therefore, by adjusting the displacement amount of the fusing member 15, the resistance of both ends 17, 18 of the fusing member 15 can be optionally set within a predetermined range. Thus, the rating of the fuse element 10 can be set at various values.

The displacement amount L1 of the fusing member 15 can be adjusted using a single die. Therefore, labor such as replacement of the die or change of the material is not required. Thus, the fuse element having various ratings can be manufactured with good yield and the productivity can improved. Accordingly, the manufacturing cost can be reduced.

In the vicinity of both ends 17, 18 of the fusing member 15, the plate thickness of the fusible body 12 before displacement working is maintained so that the heat generated at both ends 17, 18 of the fusing member 15 is absorbed to a certain degree. For this reason, as compared with the case where the plate thickness of the entire fusible body 12 is thinned, greater resistance to a rushing current for the fuse element 10 can be obtained.

Next, referring to FIG. 3, an explanation will be given of a variation of the fuse element 10 described above.

As seen from FIG. 3, a fuse element 10' is different from the above fuse element 10 in that the quantities offset at both ends 17, 18 of a fusing member 15' are different from each other.

The displacement amount L2 at the one end 17 of the fusing member 15' connected to the connecting portion 13 and the displacement amount L3 at the other end (one end) 18 of the fusing member 15' connected to the connecting portion 14 are in a relationship: L2<L3. Therefore, the sectional area of the one end 18 of the fusing member 15 is reduced more greatly and its resistance is increased more greatly. Thus, the one end 18 will be fused. In this way, if the fused area can be specified, this is convenient to confirm fusing. For example, in the case of a multi-fuse element in which a plurality of fusible bodies 12 are vertically arranged, if the one end 18 whose sectional area is smaller of both ends of the fusing member 15 is arranged on the side of a window for confirming the fusing, the fusing can be always confirmed, thereby improving the visibility.

This invention should not be limited to the embodiments described above, but can be freely modified or improved as occasion demands. Further, the material, shape, size, numerical value, format, number and location of each of the constituent elements in the embodiments described above are optional and should not be limited as long as this invention can be realized.

What is claimed is:

1. A fuse element, comprising:

a first conductive part and a second conductive part; and a fusible body which electrically connects the first conductive part and the second conductive part, and is adapted to fuse when an overcurrent flows therethrough;

wherein the fusible body is formed in a plate shape;

wherein the fusible body has a first connection portion, a second connection portion and a fusing member adapted to fuse when the overcurrent flows therethrough, a first end and a second end of the fusing member being connected to the first connection portion and the second connection portion respectively;

wherein the first connection portion and the second connection portion form a common plane; and wherein a central material of the fusing member is displaced perpendicularly away from the common plane while maintaining a thickness of the fusing member before and after the displacement, thus forming a first and a second displacement defined by a distance between the first and second ends of the fusing member and the common plane, respectively;

wherein cross-sectional contact areas of the first and second ends respectively connected to the first and second connection portions are reduced as a result of displacing the fusing member, thereby increasing the electrical resistance at the first and second ends relative to the first and second connection portions by a predetermined amount.

2. The fuse element according to claim 1, wherein the first displacement amount is different from the second displacement amount so as to provide for different electrical resistances between the first connection portion and the fusing member and the second connection portion and the fusing member.

3. The fuse element according to claim 2, wherein the first displacement amount is greater than the second displacement amount, and wherein an electrical resistance of the first end of the fusing member is greater than an electrical resistance of the second end of the fusing member.

4. The fuse element according to claim 1 wherein the fusible body is made of a copper alloy.

5. The fuse element according to claim 1, wherein the second end of the fusing member has a greater cross-sectional area than the first end of the fusing member.

6. The fuse element according to claim 1, wherein the fusing member is substantially parallel to the common plane as a result of being displaced.

7. The fuse element according to claim 1, wherein the fusing member intersects the common plane at an acute angle.

8. The fuse element according to claim 1, wherein the first connection portion, the second connection portion, and the fusing member are made up of the same material.

9. The fuse element according to claim 1, wherein the first conductive part, the second conductive part, the first connection portion, and the second connection portion form the common plane.

10. The fuse element according to claim 1, wherein the fusing member is displaced from the common plane such that a top surface and a bottom surface of the fusing member is displaced from a top surface and a bottom surface of the common plane, respectively.

11. The fuse element according to claim 1, wherein the first and second displacements cause an end of each of the first and second connecting portions to be exposed by the first and second displacement amounts, respectively.

12. The fuse element according to claim 1, wherein the fusing member extends along a plane that intersects the common plane at an acute angle.

13. The fuse element according to claim 1, wherein the maintaining of the thickness of the fusing member causes heat which is generated at the first and second ends of the fusing member to be absorbed which causes the fuse element to be more resistant to a rushing current than a fuse element that did not maintain a thickness of a fusing member.

14. The fuse element according to claim 1, wherein the thickness of the fusing member is maintained to be substantially the same as a thickness of the first connecting portion and the second connecting portion.

15. A method of manufacturing a fuse element having a fusible body electrically connecting a first conductive part and a second conductive part, wherein the fusible body is adapted to fuse when an overcurrent flows therethrough, comprising:

forming the fusible body in a plate shape, the fusible body having a first connection portion, a second connection portion and a fusing member adapted to fuse when the overcurrent flows therethrough, wherein a first end and a second end of the fusing member are connected to the first connection portion and the second connection portion respectively, displacing the fusing member perpendicularly away from the first connection portion and the second connection portion in a first direction to a point where the fusing member lies outside of a common plane of the first connection portion and the second connection portion while maintaining a thickness of the fusing member before and after the displacement, thus forming a first and second displacement defined by a distance between the first and second ends of the fusing member and the common plane, respectively;

wherein cross-sectional contact areas of the first and second ends respectively connected to the first and second connection portions are reduced as a result of displacing the fusing member, thereby increasing the electrical resistance at the first and second ends relative to the first and second connection portions by a predetermined amount.

16. The method of manufacturing a fuse element according to claim 15, wherein the first displacement amount is different from the second displacement amount.

17. The method of manufacturing a fuse element according to claim 15, wherein the fusible body is made of a copper alloy.

18. The method of manufacturing a fuse element according to claim 15, wherein the maintaining of the thickness of the fusing member causes heat which is generated at the first and second ends of the fusing member to be absorbed which causes the fuse element to be more resistant to a rushing current than a fuse element that did not maintain a thickness of a fusing member.

19. The method of manufacturing a fuse element according to claim 15, wherein the thickness of the fusing member is maintained to be substantially the same as a thickness of the first connecting portion and the second connecting portion.

* * * * *